US005556027A

United States Patent [19]

Fiedrich

[11] Patent Number: 5,556,027

[45] Date of Patent: Sep. 17, 1996

[54] HYDRONIC HEATING OUTDOOR TEMPERATURE RESET SUPPLY WATER TEMPERATURE CONTROL SYSTEM

[76] Inventor: Joachim Fiedrich, 20 Red Pine Dr., Carlisle, Mass. 01741

[21] Appl. No.: 529,938

[22] Filed: Sep. 18, 1995

Related U.S. Application Data

[63] Continuation of Ser. No. 222,884, Apr. 5, 1994, abandoned.

[51] Int. Cl.[6] ..... F24D 3/00

[52] U.S. Cl. ..... 237/8 C; 236/91 F; 236/99 E

[58] Field of Search ..... 236/91 F, 99 E; 237/8 C, 8 R

[56] References Cited

U.S. PATENT DOCUMENTS

| | | | |
|---|---|---|---|
| 2,211,672 | 8/1940 | Reeder | 236/99 EX |
| 2,661,906 | 12/1953 | Stahlberg | 237/8 CX |
| 4,679,729 | 7/1987 | Petiejean et al. | 236/91 FX |
| 4,708,287 | 11/1987 | De Wit | 236/91 FX |
| 5,119,988 | 6/1992 | Fiedrich | 237/8 C |

FOREIGN PATENT DOCUMENTS

| | | | |
|---|---|---|---|
| 2651569 | 5/1978 | Germany | 236/91 F |

*Primary Examiner*—William E. Tapolcal
*Attorney, Agent, or Firm*—Robert T. Dunn

[57] ABSTRACT

A hydronic heating system having a source of hot supply water and a reservoir of cooler return water, a supply water line from the source, a return water line to the reservoir and at least one heating loop through which water flows from the supply line to the return line, a three-way valve for feeding return water from the return water line to the supply water line to reduce the temperature of water flow to said heating loop and a valve feedback controller for varying the temperature of water flow to the heating loop, has an input to the valve controller representative of outdoor temperature, so that the temperature of water flow to the heating loop is increased or reduced when outdoor temperature falls or rises, respectively.

28 Claims, 9 Drawing Sheets

HYDRONIC HEATING OUTDOOR TEMPERATURE RESET SUPPLY WATER TEMPERATURE CONTROL SYSTEM

This is a continuation of application Ser. No. 08/222,884, filed Apr. 5, 1994, now abandoned.

BACKGROUND OF THE INVENTION

This invention relates to hydronic heating systems for dwellings, offices, etc. and more particularly to apparatus having supply header water temperature control and responding to outdoor ambient temperature for maintaining the system supply header water temperature within a predetermined range depending on the outdoor ambient temperature.

Hydronic heating systems for heating the rooms in a dwelling, office, etc, are used widely in Europe and to a lesser extent in the United States. Water heated in a boiler is distributed to heating loops of tubing in the dwelling that carry the heat by radiation, conduction and convection to the rooms in the dwelling. A common technique provides a boiler hot water supply feeding the supply header of the heating loops and the boiler water return to which the return header of the heating loops connects. The return water is heated in the boiler and sent out again as hot supply water, and so the water is cycled through the essentially closed system. One or more water pumps in this system keep the water flowing and valves control water flow rates through the loops depending on demand.

A heating loop may include several heating elements like wall mounted radiators and/or baseboard finned tubing that are the principal heat exchangers of the loop, or the tubing itself may be the principal heat exchanger of the loop. In the latter case the tubing is usually buried in the floor of a room and the tubing heats the floor. Often the tubing is buried in a special concrete and so heat exchange is principally by conduction and radiation to the concrete, which in turn heats the room by some conduction and convection, but principally by radiation. Hence, this type of heating is called Radiant Floor Heating (RFH).

In such RFH systems and other hydronic heating systems using wall radiators and/or baseboard finned tubing elements, the supply water temperature from the boiler must be controlled so that it does not exceed certain limits that are substantially lower than the usual boiler supply water temperature. There are several reasons for this: first, the temperature of radiator elements on the wall must not be so high that they are not safe to touch; second, for RFH the floor temperature must not be uncomfortable hot; and third, where the tubing is plastic, the water temperature for some plastic materials must not exceed about 140° F. Good quality "cross-linked" polyethylene tubing, on the other hand, can carry water at temperature in excess of 140° F. without any deterioration of the tubing or the tubing oxygen barrier.

In hydronic heating systems subject to such water temperature limitations, where the boiler is powered by burning fossil fuels, the boiler water supply temperature is usually well above 140° F. and often at about 180° F. to 200° F., and so the boiler supply temperature must be stepped down before it is fed to the heating loops. In the past, an electrically controlled motorized mixing valve has been used in the boiler supply line that feeds the supply header for the heating loops, between the boiler supply and the heating loops supply header. This mixing valve has two inputs and one output. One input is directly from the boiler hot water supply, the other input is from the return header of the heating loops and the output is directly to the supply header of the heating loops. The mixing valve motor is electrically energized by remote reset controls that sometimes respond to outside ambient temperature, inside room temperature, boiler water temperature, supply header water temperature, etc. In operation, the mixing valve mixes some return water with the hot supply water to reduce the temperature of the supply water that is fed to the supply header of the heating loops. Such prior systems perform quite satisfactorily, but they are relatively expensive, require remote transducers and electric power to the valve's motor and relatively greater skill to install and adjust for efficient operation.

In an effort to reduce expense, non-motorized mixing valves have been used in the boiler supply line. These have the disadvantage of providing less comfort and lower long term fuel economy. However, for the small installation (kitchen-bath addition, etc. to a dwelling), where it is difficult to justify the cost of a more sophisticated motorized valve and its electric controls, these systems are sometimes used. They usually have a remote electrically operated room thermostat controlling a circulator wired through a surface aquastat to prevent overheated water from entering the heating loops; and on the boiler supply line is a dial thermometer that indicates the supply water temperature into the loop supply header. However, manually setting the water temperature into the heating loops by adjusting the valve setting is not precise. Often within a few hours after start up, when temperatures throughout the system have stabilized, fluctuations of the boiler supply water temperature, or varying load conditions at other parts of the system will cause excessive fluctuations of water temperature delivered by the valve to the heating loops supply header. These systems have no feedback control to the mixing valve that is derived from the heating loop supply header water temperature.

Use of non-motorized valves with supply header water temperature feedback is a substantial improvement and is described in my U.S. Pat. No. 5,119,988, which issued Jun. 9, 1992, entitled: Hydronic Heating Water Temperature Control System. That patent describes several hydronic heating systems with a non-motorized (non-electric) valve having supply water temperature feedback to the valve controller. In some of those systems, the valve is a return valve in the return water line and in another system, it is a mixing valve in the supply water line. The diverting valve and the mixing valve are quite different. The diverting valve has one input and two outputs and diverts water from the return line (on the way from the heating loop return header to the boiler return), to the boiler supply line that feeds the loop supply header, diluting the supply water (reducing its temperature) that is fed to the heating loop supply header. The mixing valve has two inputs and one output and mixes some of the cooler return water with the hot supply water from the boiler and feeds the mixture (diluted supply water) to the heating loop supply header.

That patent teaches use of a non-electric thermostatic actuator head attached to the valve for positioning the valve stem and controlled by a capillary temperature sensor. Thus, the valve is modulated by non-electric feedback of the diluted supply water temperature. As described in that patent, the bulb of the capillary sensor is inserted into the diluted supply water or it may be clamped to the supply line next to the supply header so that it is at the temperature of water in the supply header. Capillary fluid in the bulb expands with temperature applying a pressure force through the capillary to the actuator head and so the valve is modulated to increase or decrease the flow of return water through the valve as necessary to maintain the temperature of the heating loop supply header water at or below a predetermined value. That value can be set by a mechanical setting on the actuator head. This set point control configuration insures that an accurate reading of the supply header water temperature is made continuously and simultaneously any deviation from the setting is immediately hulled by modulating the valve.

The several embodiments of the present invention are improvements to such hydronic heating systems having a non-motorized, non-electric, feedback controlled valve for controlling heater loop supply header water temperature, depending on outdoor ambient temperature.

SUMMARY OF THE PRESENT INVENTIONS

It is an object of the present invention to provide a nonelectric feedback control that is responsive to outside ambient temperature for controlling supply header water temperature in a hydronic heating system so that a lower outdoor ambient temperature results in higher controlled supply header water temperature.

It is another object to provide such a hydronic heating system that is relatively less expensive than prior systems of equivalent capacity and which avoids some of the limitations and disadvantages of the prior systems.

It is another object to provide a hydronic heating system with boiler supply water temperature control that is satisfactory to avoid feeding excessively high temperature boiler supply water to the system heating loops, with a non-electric control system that can be readily adjusted to change the desired heating loop water temperature.

It is another object to provide such a hydronic heating system with boiler supply water temperature control that can be readily adjusted to change the desired water temperature feeding the system heating loop plastic tubing.

It is another object to provide such a hydronic heating system with boiler supply water temperature control that can be readily adjusted to change the desired water temperature feeding the system heating loop cross-linked polyethylene plastic tubing.

It is another object to provide such a hydronic heating system with boiler supply water temperature control that can be readily adjusted to change the desired water temperature feeding the system FRH loops.

It is another object to provide such a hydronic heating system with boiler supply water temperature control that can be readily adjusted to change the desired water temperature feeding the system radiators.

It is another object to provide such a hydronic heating system with boiler supply water temperature control that can be readily adjusted to change the desired water temperature feeding the system finned tubing heating elements.

It is a particular object of the first embodiment described herein to provide a hydronic heating system with heating loop supply header water temperature control, accomplished by diverting return water into the boiler supply line to reduce the boiler supply water temperature fed to a heating loop supply header, in consideration of outside ambient temperature, using a conventional diverting valve in the boiler return line with a conventional push/release type thermostatic actuator head that is part of a non-electric thermostatic control system.

It is a particular object of the second embodiment described herein to provide a hydronic heating system with heating loop supply header water temperature control accomplished by mixing return water with boiler supply water in the boiler supply line to reduce the boiler supply water temperature fed to a heating loop supply header, in consideration of outside ambient temperature, using a conventional non-motorized mixing valve in the boiler supply line with a conventional push/release type thermostatic actuator head that is part of a non-electric thermostatic control system.

It is a particular object of the third embodiment described herein to provide a hydronic heating system with heating loop supply header water temperature control accomplished by mixing return water with boiler supply water in the boiler supply line to reduce the boiler supply water temperature fed to a heating loop supply header, in consideration of outside ambient temperature, using a conventional non-motorized mixing valve in the usual orientation in the boiler supply line with a special thermostatic actuator head that is part of a non-electric thermostatic control system.

The first embodiment described herein is called: "System With, Diverting Valve, Water Temperature Feedback And Outdoor Temperature Control". In this embodiment, a three-way modulated diverting or by-pass valve is provided in the return line to the boiler between the heating loop return header and the boiler return. The diverting valve divides flow and has one input and two outputs.

Inside the diverting valve are two valve discs and seats on one spring loaded stem. One disc and seat controls flow from one output and the other disc and seat controls flow from the other output so that when one opens the other closes and visa versa. The usual configuration of a diverting valve is with the first output in line with the input and the second output at a right angle thereto. The input is from the heating loops return header; the first output is to the boiler return line; and the second output (the diverted output) is to the boiler supply line. Thus, the diverting valve diverts some of the cooler return water to the hot supply water to reduce the temperature of the supply water feeding the heating loop supply header. In this way, the supply water is diluted with return water, lowering the temperature of the supply water directly from the boiler.

The arrangement of stem, spring, discs and seats inside the valve is such that an external pushing force on the stem acts against the spring, moving the stem into the valve, closing the seat to the first output and opening the seat to the second output. Thus, the external force pushes the stem into the valve to reduce the temperature of supply header water. Similarly, a decrease in the external force releases the stem to increase the temperature of supply header water. The usual type of actuator head for such a diverting valve for these purposes is referred to herein as a push/release type actuator head. Thus, the diverting valve is a modulated valve and the temperature of the supply water flowing to the supply header may be detected and used as a feedback control signal to modulate the valve as described in my above mentioned U.S. Pat. No. 5,119,988.

The system water pump is preferably in the return line between the return header and the diverting valve input and so that input is at the high pressure side of the pump.

The feedback from the diluted supply water temperature is derived from a sensor bulb immersed in the diluted supply water or clamped to the supply line next to the heating loop supply header so that it is at the temperature of the diluted supply water and that feedback is modified by outdoor ambient temperature that is derived from another sensor bulb exposed to outdoor air temperature. Fluid from both bulbs is connected by capillary tubes from the bulbs to the diverting valve actuator head which drives (pushes) the valve stem into the valve against the valve spring, or releases the valve stem so that the valve spring pushes it out and so the valve is modulated to increase or decrease the dilution of supply water, as necessary to maintain the diluted supply water temperature at a predetermined value depending on outdoor ambient temperature.

In operation, the bulb fluid volume displaced is representative of the bulb fluid temperature and is delivered to the valve actuator head as a fluid volume. Thus, the feedback bulb fluid volume fed through the feedback capillary to the actuator head represents supply header water temperature and the outdoor bulb fluid volume fed through the outdoor capillary to the actuator head represents outdoor temperature. Both of these temperatures are operative through the valve actuator head to exert a force on the valve stem against the valve spring and in that way modulate the valve.

For example, when the feedback volume increases, the force exerted by the valve actuator head on the valve stem increases and this force acts against the valve spring, compressing the valve spring until the actuator force and the spring force are equal. At this balance the new position of the valve calls for more dilution. Thereafter, when outdoor temperature increases, the actuator force increases more and the valve stem is positioned for even more dilution; and visa versa. Thus, a modulated diverting valve is provided at the output of the heating loops return header, with supply water temperature feedback and outdoor temperature modulating the valve.

The second and third embodiments described herein use a mixing valve in the supply line in different orientations and with different thermostatic actuator heads. Inside a conventional mixing valve are two valve discs and seats on one spring loaded stem. One disc and seat controls flow from one input and the other disc and seat control flow from the other input so that when one opens, the other closes and visa versa. The usual configuration of such a mixing valve is with the first input in line with the output and the second input at a right angle thereto. The usual orientation of such a mixing valve in the supply line of the hydronic heating system is with the first input from the boiler supply line, the second input from the return line and the output is to the heating loop supply header.

Thus, the mixing valve mixes some of the cooler return water with the hot supply water to reduce the temperature of the supply water feeding the heating loop supply header. In this way, the supply water is diluted or tempered with return water before it is fed to the heating loops.

The arrangement of stem, spring, discs and seats inside the mixing valve is such that an external pushing force on the stem acts against the spring moving the stem into the valve, opening the seat for the first input (hot supply water for the usual orientation) and closing the seat for the second input (warm return water for the usual orientation). Thus, for this usual orientation of the conventional mixing valve in the supply line, a conventional push/release type actuator head that pushes the stem into the valve with increasing feedback or outdoor temperature cannot be used, because such pushing action opens the seat for hot supply water while closing the seat for warm return water, which is the opposite of what is required.

The second embodiment is called "System With New Orientation Of Mixing Valve, Water Temperature Feedback And Outdoor Temperature Control". It shows a new orientation of the mixing valve in the supply line, which is implemented so that a conventional push/release type actuator head can be used on the valve to carry out the required performance.

The third embodiment is called "System With Usual Orientation Of Mixing Valve, Water Temperature Feedback And Outdoor Temperature Control". It shows the conventional mixing valve in the usual orientation in the supply line of the system and uses a special actuator head that releases the valve stem (rather than pushing it into the valve) with increasing feedback or outdoor temperature and so increases dilution as is required. This special actuator head is referred to herein as a release/push type actuator head.

For all embodiments, the feedback from the diluted supply water temperature is derived from a sensor bulb immersed in the diluted supply water or clamped to the supply line next to the heating loop supply header so that it is at the temperature of the diluted supply water and that feedback is modified by outdoor ambient temperature that is derived from another sensor bulb exposed to outdoor air temperature. Also, fluid from both bulbs is connected by capillary tubes from the bulbs to the mixing valve actuator head. All embodiments have a readily adjustable, non-electric thermostatic control system, whereby the desired heating loop water temperature can be set and will thereafter increase only when there is a substantial drop in outdoor temperature.

In the second embodiment with the new orientation of the conventional mixing valve in the supply line, a conventional push/release type actuator head is used which limits the position of the valve stem, and so the valve stem stop position is modulated to increase or decrease the dilution of supply water, as necessary to maintain the diluted supply water temperature at a predetermined value depending on outdoor ambient temperature.

In the third embodiment with the conventional orientation of the mixing valve in the supply line, a special release/push type actuator head is used which limits the position of the valve stem, and so the valve stem stop position is modulated to increase or decrease the dilution of supply water, as necessary to maintain the diluted supply water temperature at a predetermined value depending on outdoor ambient temperature.

These and other features of the present inventions are revealed by the following description of embodiments of the inventions taken in conjunction with the Figures.

DESCRIPTION OF AN EMBODIMENTS OF THE INVENTION

The present invention provide means for setting and limiting the temperature of the loop supply header water of a hydronic heating system where there is temperature feedback from the loop supply header water as a function of outdoor ambient temperature and means for selecting the function (Adjustment A) and setting the desired loop supply header water temperature.

The reasons for limiting the temperature of the supply header water are several and depend upon the kind of tubing and/or heat exchanger elements that are used in the system heating loops. As mentioned above, some elements are exposed to the occupants of the dwelling and so they must not be so hot that they are not safe to touch. Where RFH is used, the floor temperature must not be uncomfortable hot and where plastic tubing is used the water temperature must be limited so as not to cause early failure of the tubing. Hence, the temperature of the supply water fed to the heating loops is controlled in view of the kind of materials used and in view of the kind of elements used in the heating loops. In a given installation, there may be more than one different kind of element and more than one different kind of material used in the heating loops, all fed from the same boiler. For this reason the improvements enable ready, reliable, in situs adjustment to insure that supply water temperature does not exceed the limitations of the elements and/or materials of each of the heating loops of the system.

FIRST EMBODIMENT

Figure 1:
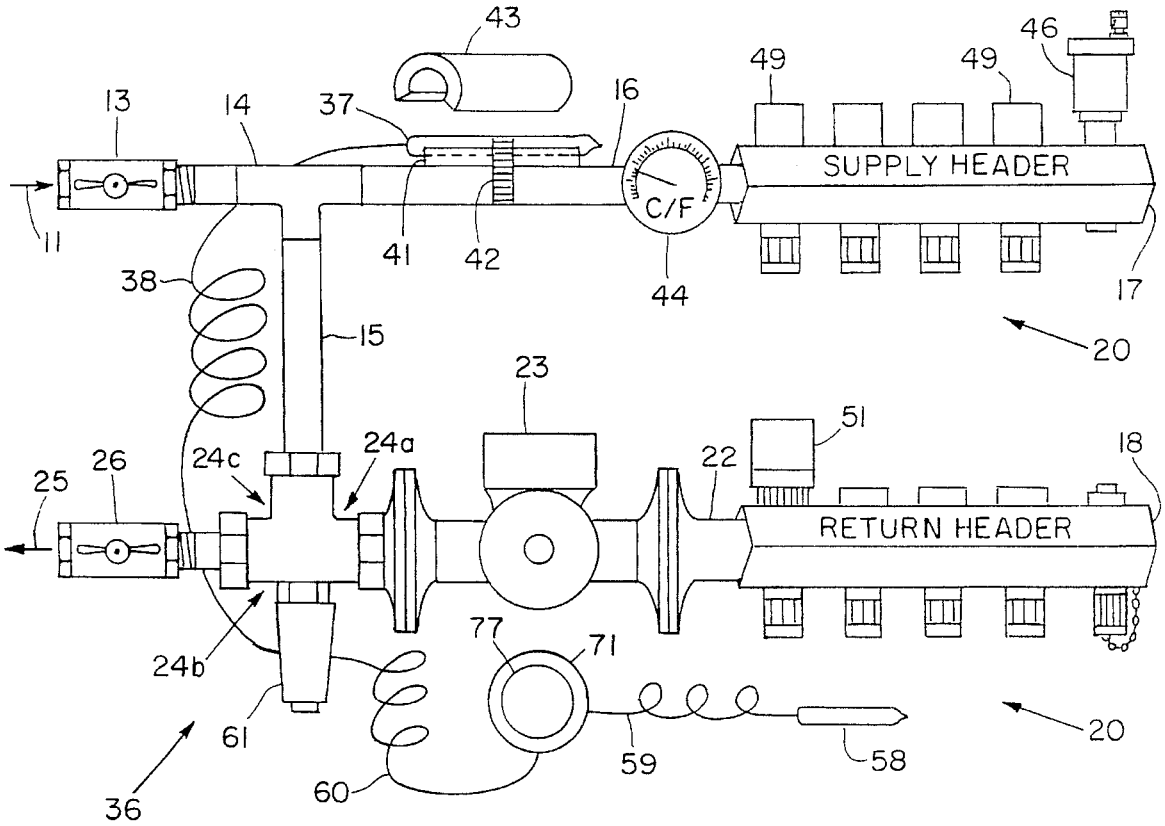
FIG. 1 is a front or elevation view of the piping configuration of the distribution station of a hydronic heating system with a diverting valve in the return line and water temperature feedback combined with outdoor temperature, according to the first embodiment.
Figure 2:
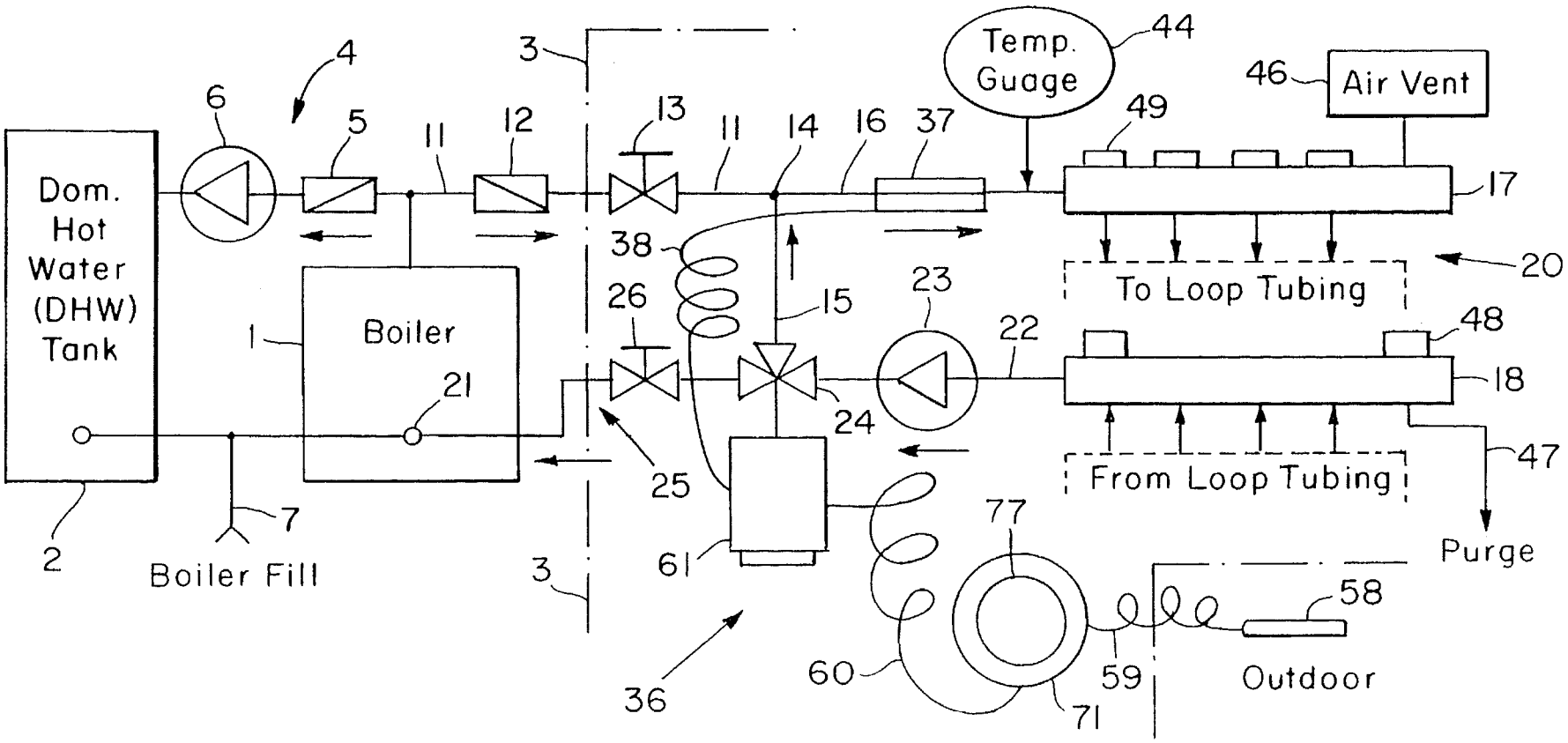
FIG. 2 is a schematic diagram of a hydronic heating system including the distribution station configuration of FIG. 1.
Figure 4:
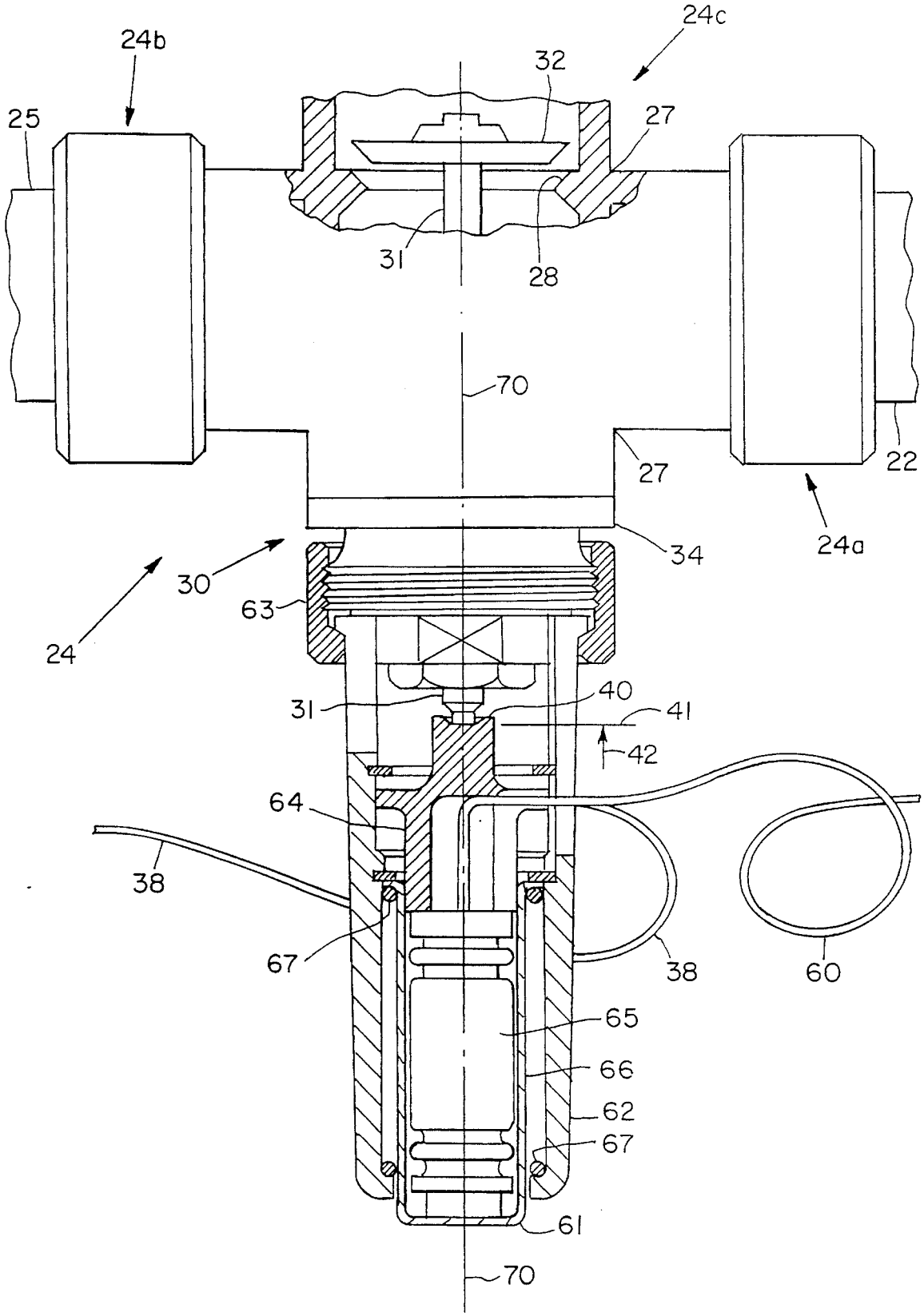
FIG. 4 is a cross section view taken through the axis of a conventional push/release type actuator head adapted for dual temperature (feedback and outdoor) response, attached to the diverting valve (or the mixing valve in the new orientation) and is effective to modulate the valve as a function of feedback supply header water temperature and outdoor ambient temperature.

System With Diverting Valve, Water Temperature Feedback And Outdoor Temperature Control Turning first to FIGS. 1 and 2, FIG. 2 is a schematic diagram of a typical hydronic heating system installed in a dwelling incorporating the first of the present inventions and FIG. 1 is a detailed elevation view of the distribution station of the hydronic system. The system includes a boiler 1 that supplies the hydronic distribution station 3 and also supplies the dwelling domestic hot water (DHW) tank 2. The usual requirement of the system is to provide DHW water at about 180° F. to 200° F., which is the usual hot water temperature requirement for washing machines and dish washers. The same boiler supply also feeds the hydronic heating system 3. As shown in FIGS. 1 and 2, the hydronic heating system distribution station 3 includes four heating loops 20, of which one or more require that the supply water temperature be substantially lower than 180° F. and so for those loops, return water is diverted to the loop supply, diluting the loop supply and so reducing the temperature (tempering) the loop supply water to within the required limits.

FIG. 1 shows details of the distribution station 3 incorporating a three-way modulated diverting valve in the return line. The boiler supply line 11 to the station includes a unidirectional check valve 12, an isolation ball valve 13, a T connection 14 to diverting line 15 and the continuation 16 of supply line 11 to heating loop supply header 17 that feeds the several (four) heating loops 20. A separate loop tubing connection to the supply header 17 is provided for each loop. At the other end of each loop a similar tubing connection is provided to the return header 18. The return line from header 18 to the boiler return reservoir 21 includes a first section 22 to water pump 23, three-way modulated diverting valve 24, boiler return line 25 and isolation ball valve 26 in the return line.

Figure 3:
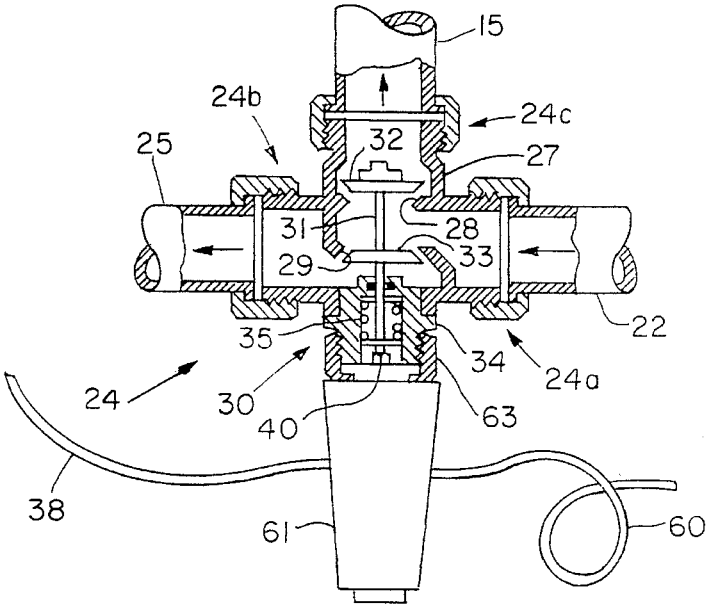
FIG. 3 is a cross section view of a typical diverting valve with a conventional push/release type actuator head adapted for dual temperature (feedback and outdoor) response.

Three-way modulated diverting valve 24 has one water flow input **24*a* from pump 23, receiving return water from the heating loops, a first water flow output 24*b* to the boiler return line 25 and a second water flow output 24*c* to diverting line 15 that connects to the supply line T connection 14. A suitable structure of diverting valve 24 is shown in FIG. 3. The valve includes a housing 27 defining the input and two outputs, a diverting flow seat 28 and a return flow seat 29. The valve spindle assembly 30 includes the stem 31, carrying the diverting flow disc 32 and the return flow disc 33 adapted to close against the seats 28 and 29, respectively. The stem is carried by the stem gland assembly 34 that fits tightly to the housing and is sealed thereto, the stem being slidably carried by the gland assembly and the stem is spring loaded by coil spring 35 which urges the stem to move in a direction that closes the diverting water passage 24*c* and opens the return water passage 24*b***. When the stem position is changed, the ratio of water flow from one output to water flow from the other output is changed.

Modulation of valve 24 is accomplished by moving the stem 31 against spring 35 and is done by delivering a force to the stem to overcome the spring resistance. The conventional push/release type actuator head adapted herein for dual temperature input in diverting valve control system 36 provides this control action to the valve stem and is shown in FIGS. 1 to 6. It is a non-electric, thermostatic, automatic push/release type, dual temperature actuating system for the diverting valve and includes: dual temperature, diverting valve, force exerting actuator head 61; ratio setter device 71; supply header water temperature thermal sensor bulb 37 and a capillary line 38 from the sensor bulb to the actuator head; outdoor ambient temperature thermal sensor bulb 58 and a capillary line 59 from the sensor bulb to the ratio setter device; and capillary line 60 from the ratio setter device to the actuator head.

The sensor bulbs and capillaries contain a fluid that expands as the fluid temperature increases, delivering additional volume of fluid via the capillaries to the push/release type actuator head 61, which converts the increased fluid volume to a new position of the valve stem at point 40. Thus, when the temperature of the fluid in a sensor bulb increases, the valve stem position is changed to increase the diverted water flow and so reduce the temperature of the loop supply header water. In this way, the temperature of the diluted supply water flowing to the loops supply header 17 (feedback temperature), combined with outdoor temperature, according to a selected operating curve (Adjustment A) is effective to modulate the valve for the purposes herein described.

Sensor bulb 37 is preferably located so as to detect the temperature of the supply water flow into header 17 that feeds the heating loops. This can be done using a structure (not shown) for inserting the bulb into the supply water line 16 or inserting the bulb into the supply header 17. It can also be done more simply by attaching the sensor bulb in intimate thermal contact with the outside of supply line 16 as shown in FIG. 1. For this purpose, the elongated sensor bulb 37 is oriented longitudinally along line 16, partially enclosed by mounting block 41 that also partially encloses line 16 and is secured tightly thereto by strap 42. Block is made of highly thermally conductive material such as copper or aluminum, to insure that the temperature of the fluid in the bulb is substantially the same as the temperature of the tempered supply water flowing-in line 16 immediately adjacent thereto. Also, this assembly may be covered with an insulating sleeve 43 to insure the equality of temperature. A visible temperature gauge 44 is also attached to line 16 close to header 17 in intimate thermal contact with the line so that it displays a temperature as near to the temperature of the tempered supply water as possible.

A suitable three-way diverting valve for use in this system is manufactured by F. W. Overtrop KG, of Olsberg, West Germany. A suitable conventional push/release type valve actuator head, sensor bulb and capillary for such an actuator head is also manufactured by Overtrop.

For added safety and ease of maintenance, the supply header 17 may be equipped with an air vent 46 and the return header may be equipped with a purge line 47 controlled by a manually operated valve 48. Supply water flow to each of heating loops may be controlled by a balancing valve with an internal position set screw. Such balancing valves for each loop are denoted 49. An alternate control for each loop could be an electrically operated power head like 51, each controlled by an electrical thermostat in the dwelling.

Push/Release Type Actuator Bead 61

Actuator head 61 of dual temperature diverting valve control system 36 may be a conventional push/release type head. It includes a housing 62 that is attached to the valve housing 27 by threaded ring 63 that engages threads on the housing. The actuator head parts are generally figures of revolution about the actuator axis 70 and so all are revealed in FIG. 4. The mechanical function of the head is to respond to bulb fluid volume changes and, accordingly, modulate the valve. An increase in either bulb temperature (feedback or outdoor) increases the total bulb fluid volume, which expands a bellows in the actuator head, pushing the valve stem 31 into the valve against the resistance of valve spring 35 to allow more warm return water flow to the loop supply header (more dilution). On the other hand, a decrease in either bulb temperature (feedback or outdoor) decreases the total bulb fluid volume and the bellows contracts, releasing the valve stem 31, which moves out of the valve as urged by valve spring 35 to reduce warm return water flow to the loop supply header (less dilution). Thus, the dual temperature actuator head modulates the valve.

Within housing 62, movably contained therein, is the actuator piston 64 that provides stem driver 40 at position 41 in the Figure. The stem driver 40 moves toward the valve, in the direction of arrow 42, when the feedback temperature or the outdoor temperature increases (or the manual bias setting of dial 77 is increased). Either temperature rise calls for more warm return water flow (more dilution). These temperatures are represented by the bulb fluid volume which expands from the bulbs 37 and 58, through the capillary tubes 38, 59 and 60, into the actuator head bellows 65, causing it to expand inside sleeve 66, driving the sleeve slightly out of housing 62 against captured actuator spring 67 and driving piston 64 in the opposite direction toward the valve. As spring 67 compresses, its force exceeds the compressed force of valve spring 35 and so spring 35 is compressed more, and the valve is positioned to increase warm return water flow through the valve between valve plug 32 and its seat 28. This increased return water flow to the loop supply header increases dilution and lowers the temperature of water in the supply header.

Figure 6:
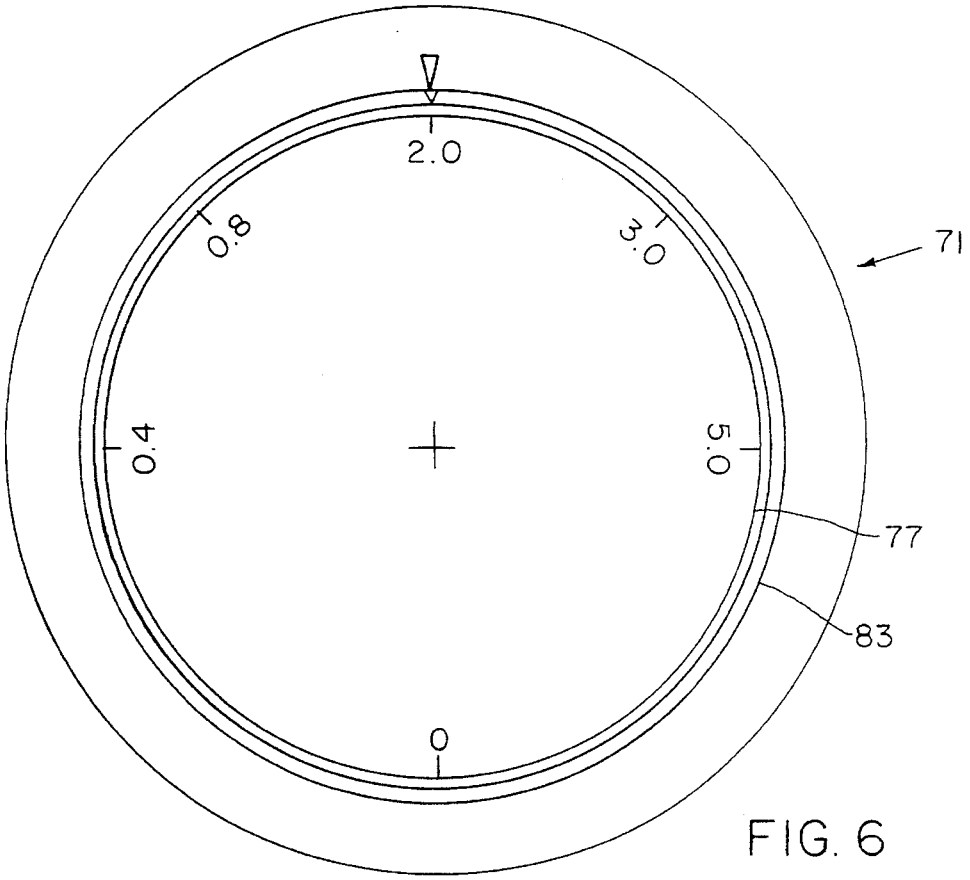
FIG. 6 is a face view of the ratio setter device showing the manual dial for setting the Adjustment A value.
Figure 5:
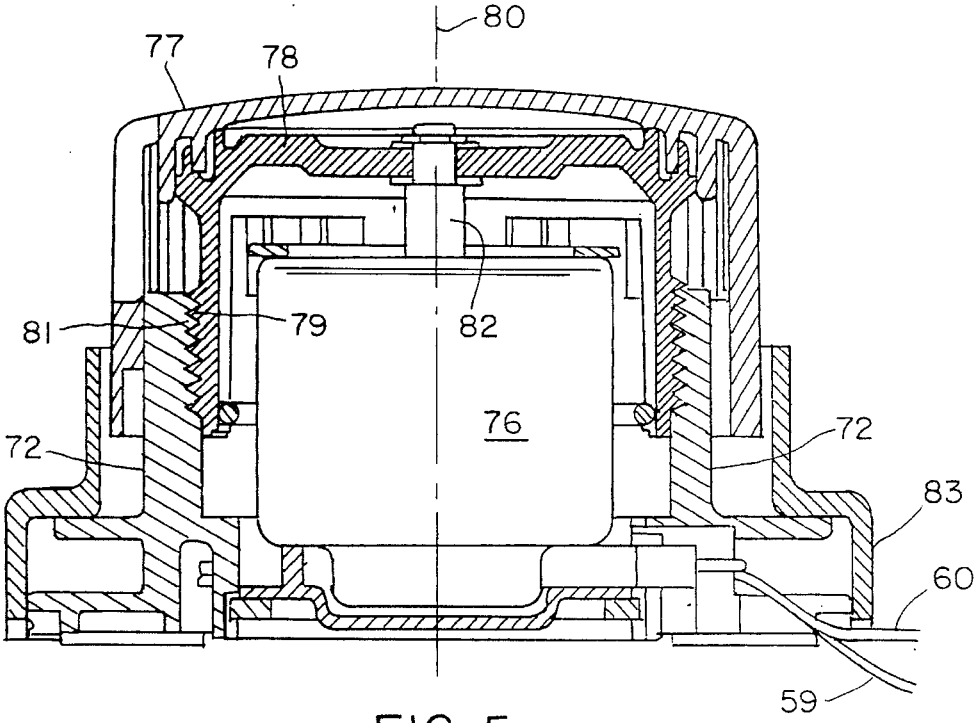
FIG. 5 is a cross section view taken through the axis of the ratio setter device that is used to set the Adjustment A value and so select the operating curve (see FIG. 7) of feedback supply header water temperature versus outdoor ambient temperature for the diverting or the mixing valve embodiments described herein.

The bulb fluid volume that expands into or contracts from the actuator head bellows 65 for a given feedback temperature depending on the outdoor temperature and the setting (Adjustment A) of dial 77 of ratio setter device 71 shown in FIGS. 5 and 6. For example, when the outdoor temperature drops, the total bulb fluid volume decreases and so the actuator releases the valve stem, which moves out of the valve to a new position for less dilution (higher loop supply water temperature). The relative effect of outdoor temperature on the stem position (the valve position) compared to the effect of the feedback temperature is adjustable: it depends on the setting of manual dial 77 of ratio setter device 71,(Adjustment A), as described more fully below.

Setting the manual dial 77 of device 71, even without a change in outdoor temperature can be used to set the desired loop supply header water temperature. Thereafter, any change in feedback temperature will change the stem stop position to maintain the set temperature. Thus, the manual setting of dial 77, in effect, sets a bias on the effect of supply header water feedback temperature.

Ratio Setter Device 71

The ratio setter device 71 is shown in FIGS. 5 and 6. It is designed for mounting on a wall for easy access and operation. The structure is generally a figure of revolution about axis 80 and so is fully revealed by the cross-section view through the axis of FIG. 5. It contains within structural frame 72 a sealed fluid bellows 75 in a container 76, the bellows being attached to the bottom of the container. The outdoor bulb 58 capillary 59 connects to bellows 75 and capillary tube 60 connects bellows 75 to the valve actuator head bellows (65 for the diverting valve or 165 for the mixing valve). Thus, the volume of bellows 75, which is manually adjustable, provides a manually adjustable bias on the effects of feedback and outdoor temperature as they are fed to actuator head 61. When bellows 75 volume is large, the effects of feedback and outdoor temperature changes on the actuator head are reduced. Similarly, when bellows 75 volume is small, the effects of those temperature changes on the mixing valve are greater.

Figure 7:
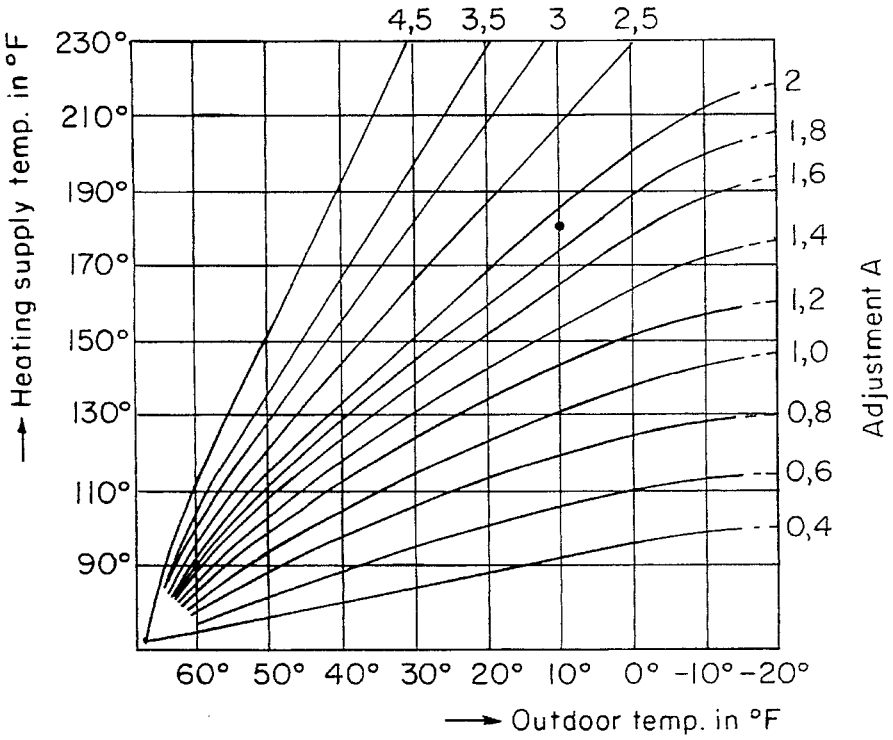
FIG. 7 is a family of curves of supply header water temperature versus outdoor ambient temperature for a range of Adjustment A values from 0.4 to 4.5 showing the general relationship of those parameters that can be provided for any of the embodiments described herein.

Ratio setter device 71 has a protective cover 83 that encloses the frame 72 and dial 77. The manually variable bellows 175 in it is used to select the operating curve of feedback temperature (heating loop supply temperature) versus outdoor temperature as shown in FIG. 7. Stated in another way, it is also used to set (increase or decrease) the temperature of the loop supply header water.

For these uses, dial 77 engages threaded cylinder 78 having outside threads 79 that engage inside threads of frame 172 and cylinder 78 rotatably carries bellows drive rod 82 that is fixed centrally to the bellows. As dial 77 is turned on axis 80, screwing 78 into 72, the volume of bellows 75 is reduced and as it is screwed out the volume of that bellows is increased. Thus, the dial setting calls for more or less effect of outdoor temperature on loop supply header water temperature. The dial selects the operating curve of the water temperature versus outdoor temperature, as shown in FIG. 7 and that setting is called herein Adjustment A.

Operation of The System

An initial adjustment of the system when operation first commences can be carried out as follows:

(a) with supply water flowing to one or more of the heating loops, observe the temperature indication of temperature gauge 44;

(b) if the temperature indicated by gauge 44 is too high, rotate manual dial 77 of ratio setter device 71 decreasing the index number (Adjustment A) that is in line with the marker thereof, thereby decreasing the volume of ratio setter bellows 75, and forcing more fluid, via capillary 60 into actuator head bellows 65, pushing the valve stem further into the valve (lowering the stop level 40), increasing dilution and so reducing the temperature of the water in the loop supply header;

(c) on the other hand, if the temperature gauge 44 reads too low, rotate dial 77 to increase the Adjustment A number and the temperature of the supply water flow to loop header 17 is increased.

These adjustments are made until the system operates steadily at the supply water temperature indicated by temperature water gauge 44 that is desired. At that point, the system is, in effect, calibrated for automatic feedback operation for the prevailing outdoor temperature and will deliver mixed (tempered) supply water to header 17 at the desired temperature even though various heating loops are turned on and off, depending upon demand, and the boiler supply water temperature fluctuates up and down, again depending upon demand. Thereafter, if outdoor temperature drops sufficiently, the tempered water temperature allowed is increased; or, conversely, if outdoor temperature increases sufficiently, the tempered water temperature allowed is decreased.

FIG. 7 is a heating curve diagram showing a family of curves of heating loop supply header water temperature versus outdoor ambient temperature for a range of Adjustment A values for ratio setter device 71 from 0.4 to 4.5.

For added safety and ease of maintenance, the supply header 17 may be equipped with an air vent 46 and the return header may be equipped with a purge line 47 controlled by a manually operated valve 48. Supply water flow to each of heating loops may be controlled by a balancing valve with an internal position set screw. Such balancing valves for each loop are denoted 49. An alternate control for each loop could be an electrically operated power head like 51 each controlled by an electrical thermostat in the dwelling.

SECOND EMBODIMENT

Figure 8:
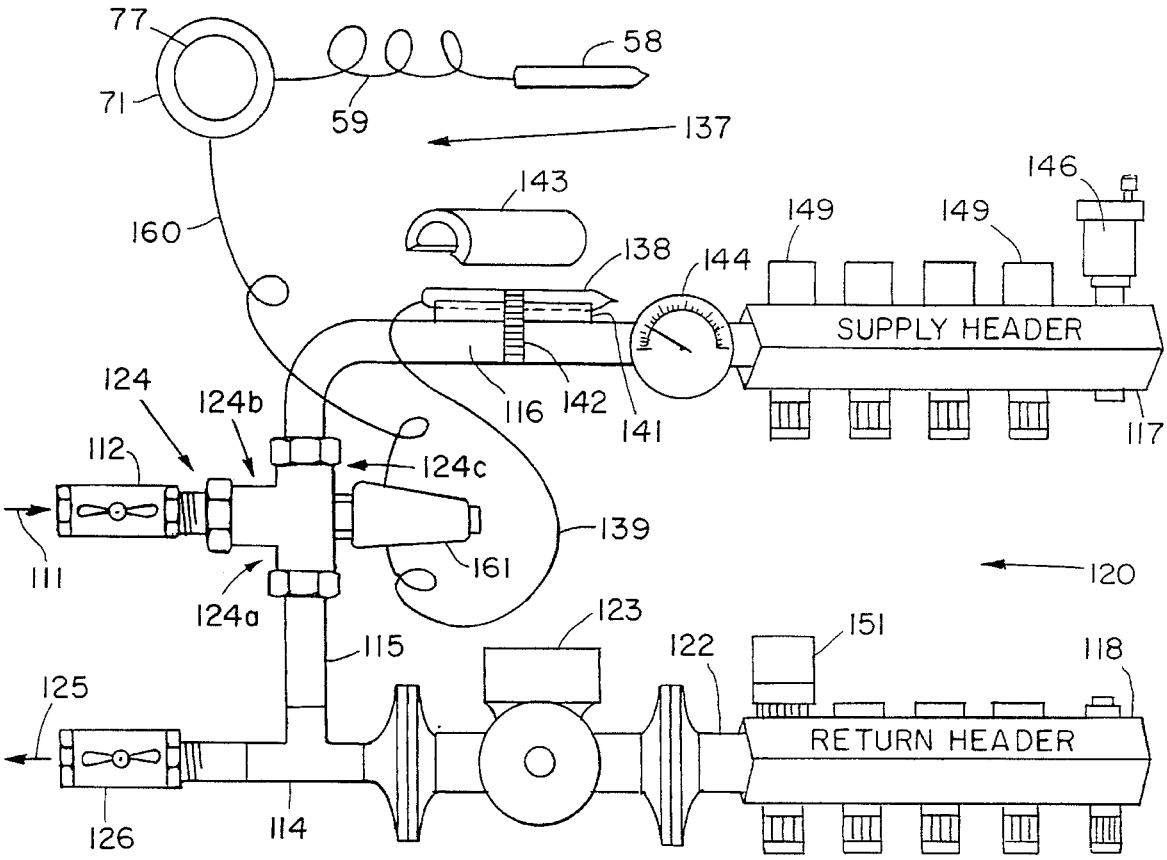
FIG. 8 is a front or elevation view of the piping configuration of the distribution station of a hydronic heating system with a mixing valve in a new orientation in the supply line and a control system responsive to water temperature feedback combined with outdoor temperature, according to the second embodiment herein.
Figure 9:
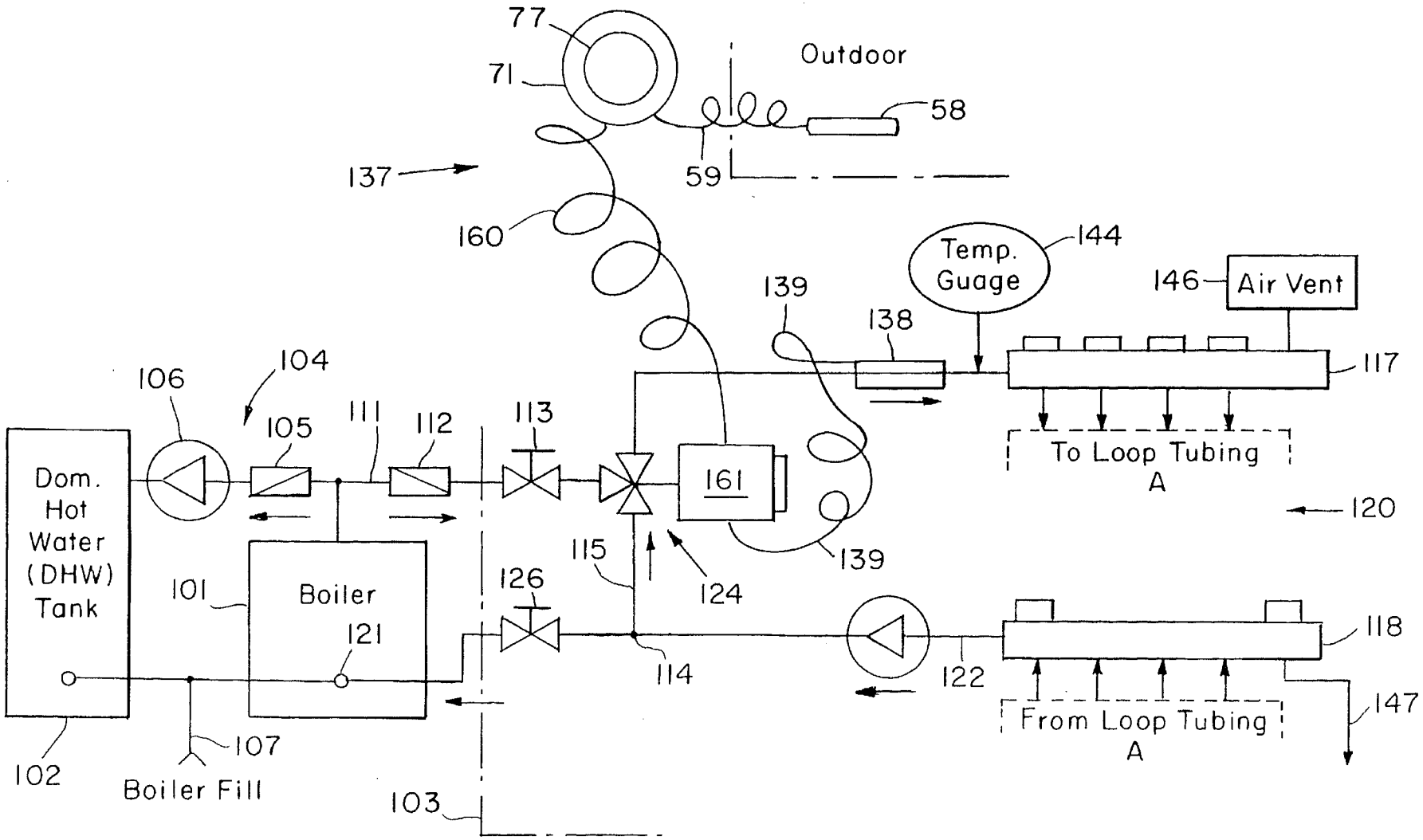
FIG. 9 is a schematic diagram of a hydronic heating system including the distribution station configuration of FIG. 8.

System With New Orientation Of Mixing Valve, Water Temperature Feedback And Outdoor Temperature Control Turning to FIGS. 8 and 9, FIG. 9 is a schematic diagram of a typical hydronic heating system installed in a dwelling incorporating features of the second embodiment herein and FIG. 8 is a detailed elevation view of the distribution station of the system. The boiler 101 supplies the system distribution station 103 and the domestic hot water (DHW) tank 102. The boiler provides DHW water at about 180° F. to 200° F. as required for washing machines and dish washers and the boiler supply also feeds the hydronic heating system. As shown, the hydronic heating system includes four heating loops 120 between supply header 117 and return header 118, of which one or more require that the supply water temperature be substantially lower than 180° F. and so for those loops, return water is mixed with supply water, diluting (tempering) the loop supply and so reducing the temperature of the loop supply water to within the required limits.

FIG. 8 shows details of the distribution station 103 incorporating the new orientation of a conventional three-way modulated mixing valve 124 in the boiler supply line 111. The boiler supply line also includes a unidirectional check valve 112, isolation ball valve 113 and the continuation 116 of supply line 111 to heating loop supply header 117 that feeds the several (four) heating loops 120, a separate loop tubing connection to the supply header being provided for each loop. At the other end of each loop a similar tubing connection is provided to the return header 118.

The return line from header 118 to the boiler return reservoir 121 includes a first section 122 to water pump 123, a T connector 114 to the three-way modulated mixing valve 124, boiler return line 125 and isolation ball valve 126 in the return line.

The conventional mixing valve 124 has two inputs, a first input **124*a* and a second input 124*b*, and one output 124*c*. In the usual orientation of this valve in the system supply line, first input 124*a* is fed directly by supply line 111, second input 124*b* is fed by shunt line 115 that feeds return water to the valve from the T connector 114 and the output is to the supply header line 116. However, the new orientation, shown in FIGS. 8 and 9 is used in this embodiment by switching the inputs, so that input 124*b* is fed directly by boiler supply line 111 and input 124*a* is fed by return water shunt line 115**.

Figure 10:
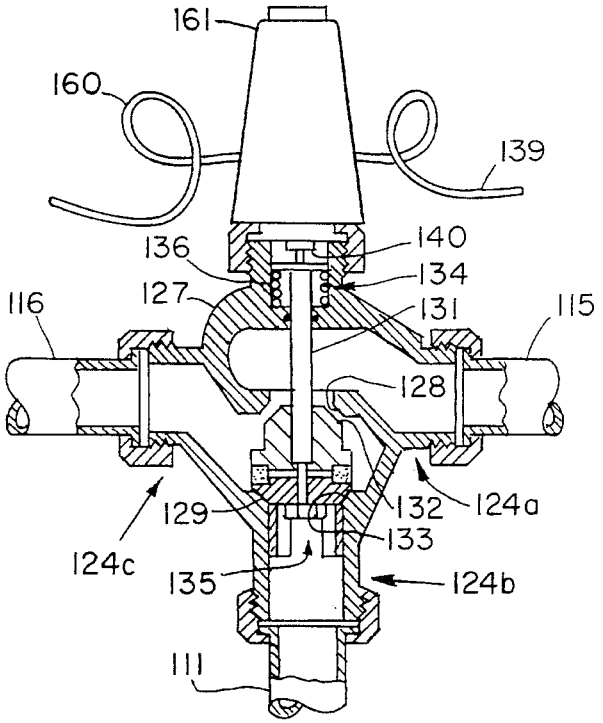
FIG. 10 is a cross section view of a conventional mixing valve for the new orientation in the supply line with a conventional push/release type actuator head adapted for dual temperature (feedback and outdoor) control according to the second embodiment herein.

A suitable structure of mixing valve 124 is shown in FIG. 10, which is a cross-section view of the valve as it is viewed in FIG. 8 and the cross-section is taken parallel to the plane of the drawing. The valve includes a housing 127 defining the two inputs and the output, a return water flow seat 128 and a supply water flow seat 129. The valve spindle assembly 130 includes the stem 131, carrying the return flow plug 132 and the supply flow plug 133 adapted to close against the return and supply flow seats 128 and 129, respectively. The stem is carried by the stem spring guide assembly 134 at one end, and the shunt input guide assembly 135 at the other end, the stem being slidable carried by these assemblies. In spring guide assembly 134, the stem is spring loaded by coil spring 136 which urges the stem to move in a direction that closes the return water input passage 124*a* and opens the supply water input passage 124*b* until the return water input passage 124*a* is completely closed or the stem hits a stop provided by actuator head 161. This action increases the temperature of the mixed water flowing from the valve output 124*c* to the heating loops supply header.

Thus, the mixing valve position in this new orientation, without an actuator head (no stem stop) is for minimum dilution, because there is no stop provided by an actuator head and so the valve spring drives the stem until the return flow plug 132 contacts the return flow seat 128. This is a not a fail-safe position, because it sends supply water at maximum temperature to the heating loops. Fail safe position is the valve position that sends minimum temperature water to the heating loops. Structures for limiting the water temperature sent to the heating loops in case the actuator is removed or fails on a diverting valve are described in my U.S. Pat. No. 5,209,401, entitled "Hydronic Heating Water Temperature Control Valve" issued May 11, 1993. Those structures can also be used on the mixing valve in this embodiment for the same purpose. They would prevent complete closure of the return water input (plug 132 in seat 128).

As already described, without the actuator head, valve 124 is modulated by moving the position of the valve stem stop 140 (see FIG. 10) and the stem spring 136 forces the valve stem to follow the stop position until the return flow plug 132 contacts return flow seat 128 shutting off return water flow to the loop header so that only hot supply water flows to that header. The dual temperature, non-electric, thermostatic, automatic, mixing valve control system 137 provides the mixing valve stem stop, by pushing or releasing the stem, and is shown in FIGS. 8, 9, 10, 5 and 6. It includes: push/release type, dual temperature, mixing valve actuator head 161; ratio setter device 71; supply header water temperature thermal sensor bulb 138 and a capillary line 139 from the sensor bulb to the head; outdoor ambient temperature thermal sensor bulb 58 and a capillary line 59 from the sensor bulb to the ratio setter device; and capillary line 60 from the ratio setter device to the actuator head. Actuator head 161 may be the same as actuator head 61 used on the diverting valve in the first embodiment and shown in detail in FIG. 4.

As in the first embodiment, the loop supply header water temperature (feedback) is provided by temperature sensor bulb 138 oriented longitudinally along line 116, partially enclosed by mounting block 141, secured thereto by strap 142 and covered with an insulating sleeve 143 to insure the equality of temperature. Visible temperature gauge 144 is also attached to line 116 close to header 117 in thermal contact with the line so that it displays the temperature of the tempered supply water that is fed to the heating loop supply header.

Each sensor bulb and capillary contains a fluid that expands as the fluid temperature increases, delivering an increased volume of fluid via the capillary to the push/release type actuator head 161, which positions the valve stem stop 140 as a function of the combined temperatures (feedback and outdoor) and the setting of dial 77 according to the operating curves shown in FIG. 7. Thus, when the temperature of the fluid in a sensor bulb increases, whether it is feedback or ambient, the position of the valve stem stop 140 is moved into the valve, decreasing the ratio of hot supply water to warm return water that passes through the valve to the loop supply header (increasing dilution).

Thus, this second embodiment, incorporating the new orientation of a conventional mixing valve in the system supply line, uses dual temperature valve control system 137 that is essentially the same as the diverting valve control system 36 of the first invention and operation of these control systems are essentially the same and represented by the family of curves in FIG. 7,

THIRD EMBODIMENT

Figure 11:
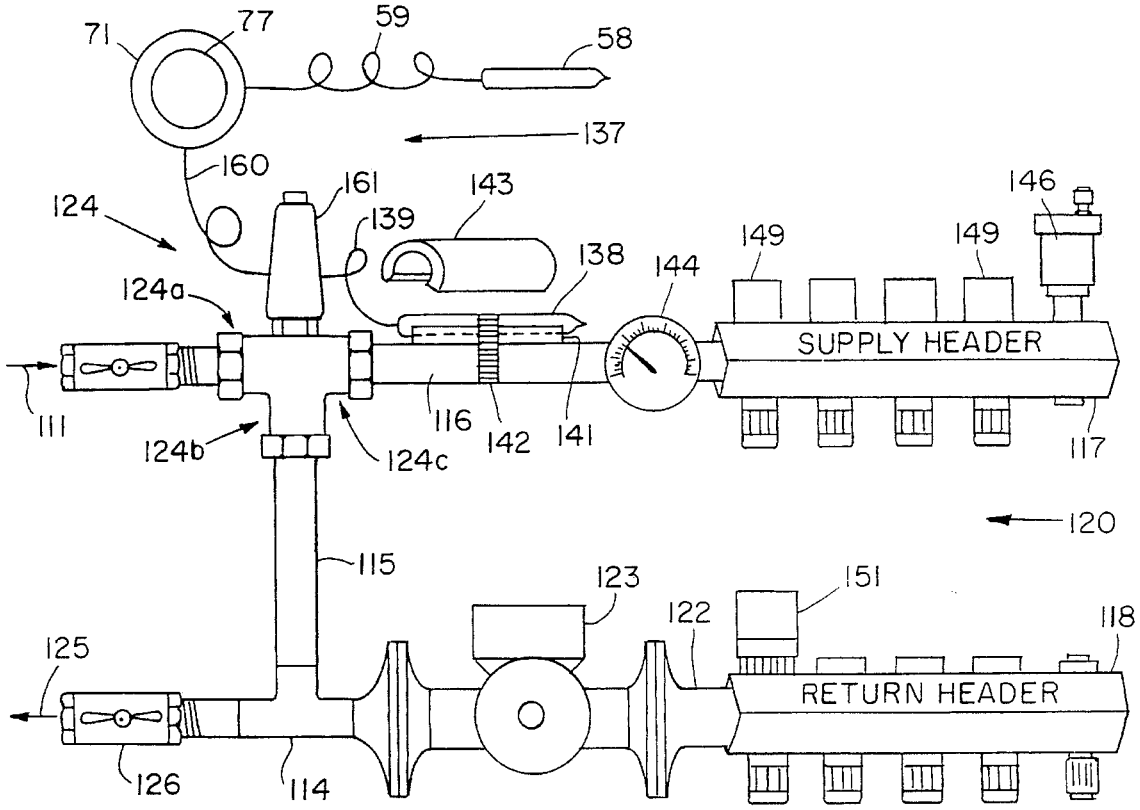
FIG. 11 is a front or elevation view of the piping configuration of the distribution station of a hydronic heating system with a conventional mixing valve in the usual orientation in the supply line and a control system responsive to water temperature feedback combined with outdoor temperature, using a special release/push type actuator head according to the third embodiment herein.
Figure 12:
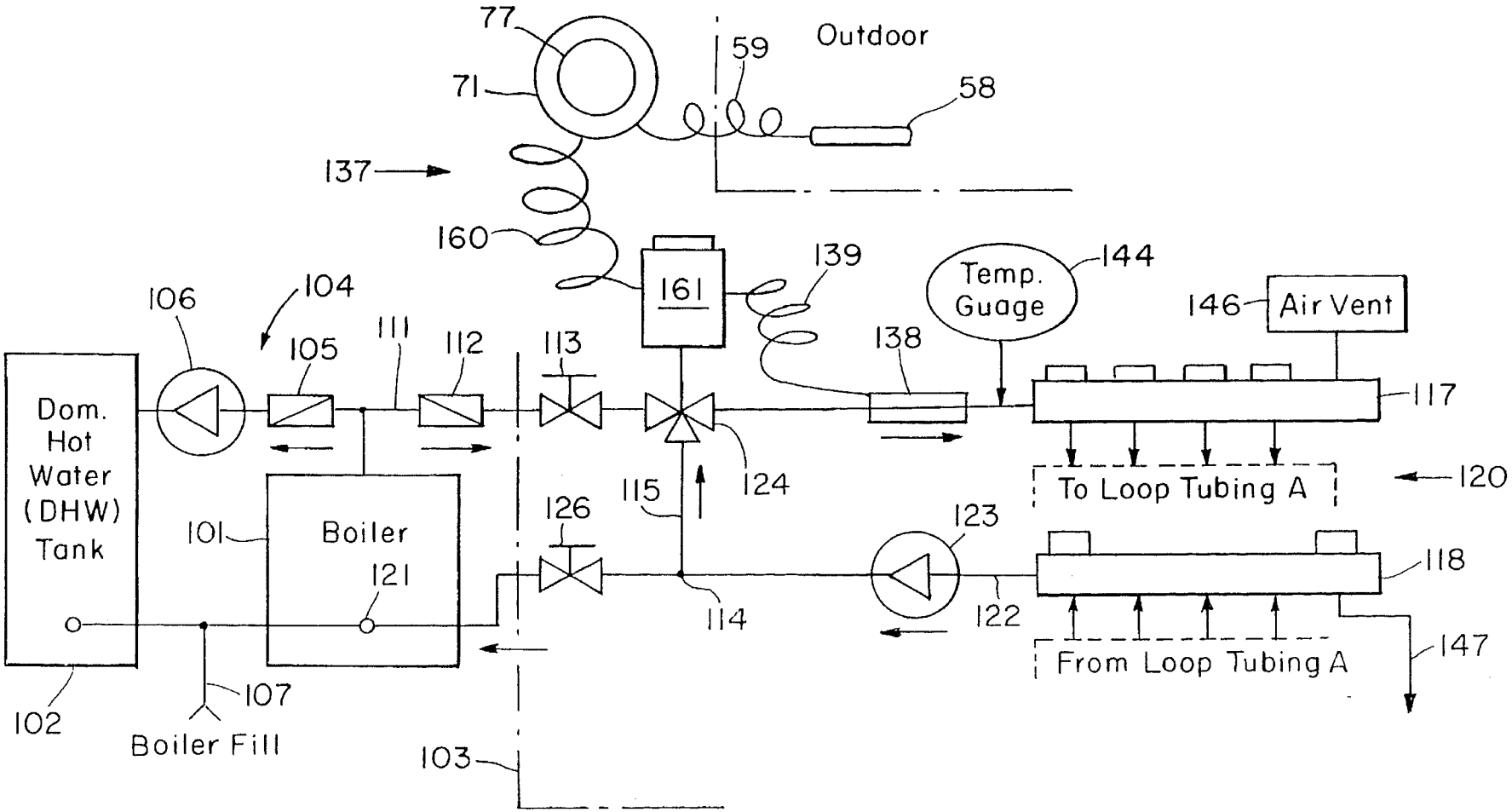
FIG. 12 is a schematic diagram of a hydronic heating system including the distribution station configuration of FIG. 11.
Figure 13:
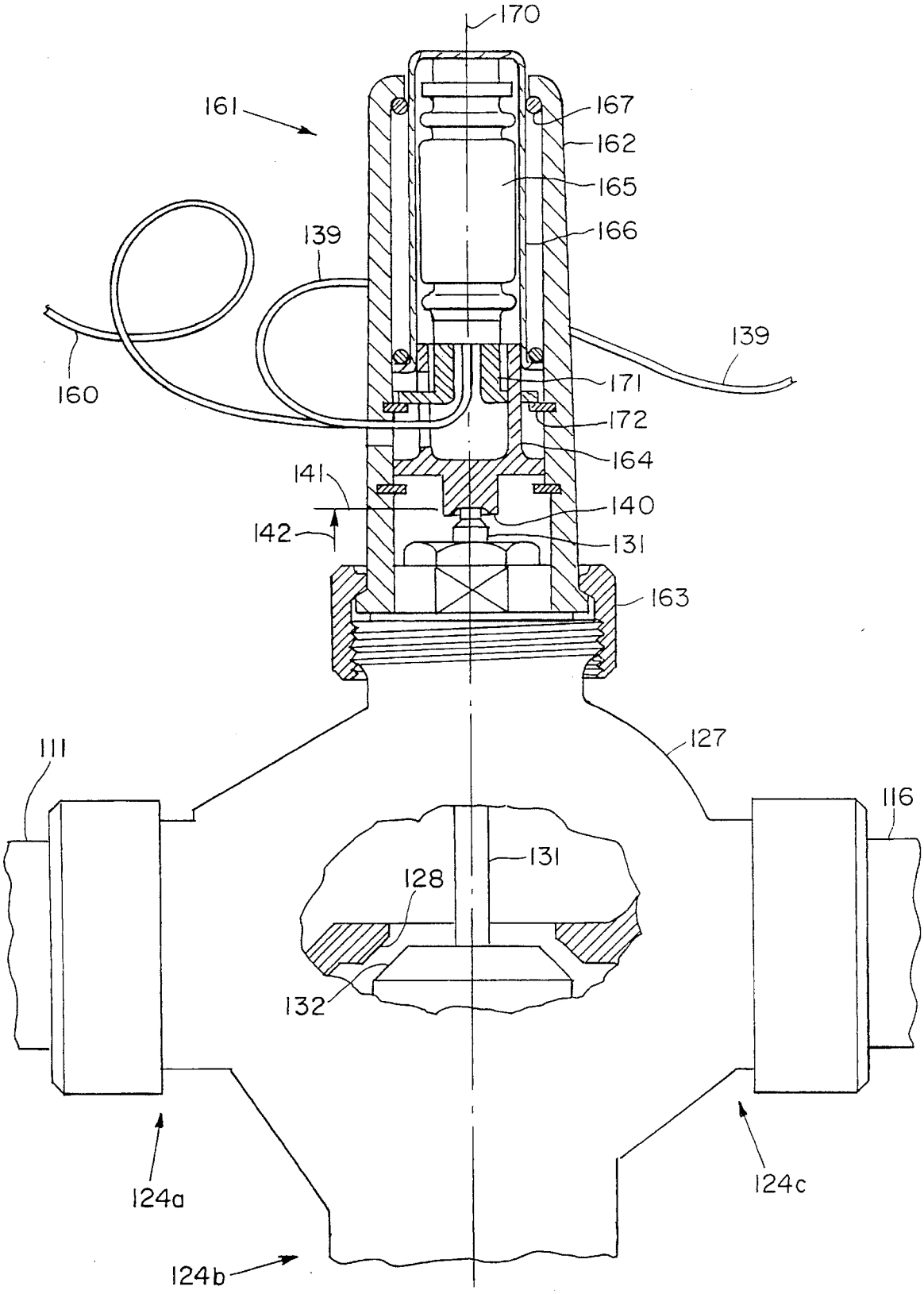
FIG. 13 is a cross section view taken through the axis of the special release/push type, dual temperature, thermostatic actuator head that is attached to the mixing valve in the usual orientation in the supply line according to the third embodiment herein.

System With Usual Orientation Of Mixing Valve, Water Temperature Feedback And Outdoor Temperature Control Turning to FIGS. 11 and 12, FIG. 12 is a schematic diagram of a typical hydronic heating system installed in a dwelling incorporating the third embodiment of the invention herein and FIG. 11 is a detailed elevation view of the distribution station of the hydronic system. Reference numbers used in this embodiment are the same as in the second embodiment where the parts may be the same and this includes the mixing valve 124 although its inputs, discs and seats have different names due to the different orientation (usual rather than the new orientation) of the valve in the system supply line. This also applies to parts of the valve dual temperature control system 237. However, it does not apply to the actuator head 271 which is not the same as actuator head 161 or 61. Actuator head 261 is a special release/push type designed for this embodiment.

As in the second embodiment, boiler 101 supplies the system distribution station 103 and the domestic hot water (DHW) tank 102 and the hydronic heating system includes four heating loops 120 between supply header 117 and return header 118, of which one or more require that the supply water temperature be substantially lower than the usual boiler supply water temperature and so for those loops, return water is mixed with supply water, diluting (tempering) the loop supply and so reducing the temperature of the loop supply water to within the required limits.

FIG. 11 shows details of the distribution station 103 incorporating the usual orientation of a conventional three-way modulated mixing valve 124 in the boiler supply line 111. The boiler supply line also includes a unidirectional check valve 112, isolation ball valve 113 and the continuation 116 of supply line 111 to heating loop supply header 117 that feeds the several (four) heating loops 120, a separate loop tubing connection to the supply header being provided for each loop. At the other end of each loop a similar tubing connection is provided to the return header 118.

The return line from header 118 to the boiler return reservoir 121 includes a first section 122 to water pump 123, a T connector 114 to the three-way modulated mixing valve 124, boiler return line 125 and isolation ball valve 126 in the return line.

The usual orientation of this valve in the system supply line has first input 124*a* fed directly by supply line 111, second input 124*b* fed by shunt line 115 that feeds return water to the valve from the T connector 114 and the output is to the supply header line 116.

The structure of mixing valve 124 is shown in FIG. 10, which is a cross-section view of the valve as it is viewed in FIG. 8 and the cross-section is taken in the plane of the drawing. In this third embodiment, the mixing valve 124 shown in FIG. 11, as viewed in cross-section in FIG. 11, would be a mirror image of the view shown in FIG. 10. With that in mind, FIG. 10 can be referred to for this third embodiment. Now referring to FIG. 10, the valve housing 127 defines two inputs and the output, a supply water flow seat 128 and a return water flow seat 129. The valve spindle assembly 130 includes the stem 131, carrying the supply flow plug 132 and the return flow plug 133 adapted to close against the supply and return flow seats 128 and 129, respectively. The stem is carried by the stem spring guide assembly 134 at one end, and the shunt input guide assembly 135 at the other end, the stem being slidable carried by these assemblies. In spring guide assembly 134, the stem is spring loaded by coil spring 136 which urges the stem to move in a direction that closes the supply water input passage **124*a* and opens the return water input passage 124*b* until the supply water input passage 124*a* is completely closed or the stem hits a stop provided by actuator head 161. This action reduces the temperature of the mixed water flowing from the valve output 124*c*** to the heating loops supply header.

Thus, the mixing valve position in this usual orientation without an actuator head (no stem stop) is for maximum dilution (minimum hot supply water flow), because there is no stop provided by an actuator head other than the supply flow plug 132 contacting supply flow seat 128. This is a fail-safe position, because it allows only warm return water to flow to the heating loops.

Valve 124 is modulated by moving the position of the valve stem stop 140 (see FIG. 10) and the stem spring 136 forces the valve stem to follow the stop position until the supply flow plug 132 contacts supply flow seat 128 shutting off hot supply water flow to the loop header so that only return water flows to that header. The dual temperature, non-electric, thermostatic, automatic, mixing valve control system 137 provides the mixing valve stem stop by releasing or pushing the stem and is shown in FIGS. 11, 12, 13, 5 and 6. It includes: special release/push type, dual temperature, stop setting mixing valve actuator head 261; ratio setter device 71; supply header water temperature thermal sensor bulb 138 and a capillary line 139 from the sensor bulb to the head; outdoor ambient temperature thermal sensor bulb 58 and a capillary line 59 from the sensor bulb to the ratio setter device; and capillary line 60 from the ratio setter device to the actuator head.

As in the second embodiment, the loop supply header water temperature (feedback) is provided by temperature sensor bulb 138 oriented longitudinally along line 116, partially enclosed by mounting block 141, secured thereto by strap 142 and covered with an insulating sleeve 143 to insure the equality of temperature. Visible temperature gauge 144 is also attached to line 116 close to header 117 in thermal contact with the line so that it displays the temperature of the tempered supply water that is fed to the heating loop supply header.

Each sensor bulb and capillary contains a fluid that expands as the fluid temperature increases, delivering an increased volume of fluid via the capillary to the special release/push type actuator head 261, which positions the valve stem stop 140 as a function of the combined temperatures (feedback and outdoor) and the setting of dial 77 according to the operating curves shown in FIG. 7. Thus, when the temperature of the fluid in a sensor bulb increases, whether it is feedback or ambient, the position 141 of valve stem stop 140 is moved in the direction of arrow 142, allowing the valve spring 136 to move the stem to the new position (releasing the stem), which increases dilution of the hot supply water fed to the loop supply header.

Release/Push Type Mixing Valve Actuator Bead 261

Actuator head 261 is not a conventional type. It is a special design for non-electric, thermostatic, water temperature feedback temperature control of the conventional mixing valve in the usual orientation in the system supply line. It is part of mixing valve control system 237 and includes a housing 162 that is attached to the valve housing 127 by threaded ring 163 that engages threads on the housing. The actuator head parts are generally figures of revolution about the actuator axis 170 and so all are revealed in FIG. 13. The function of the head is to provide the stop 140 for the mixing valve stem 131. An increase in either bulb temperature (feedback or outdoor) raises the stop so that the valve stem spring 136 moves the stem to the new (higher) stop position, decreasing the ratio of hot supply water to warm return water flow through the valve (more dilution) to the loop supply header.

Within housing 162, movably contained therein, is the stem stop body 164 that provides stop 140 at position 141 in the FIG. The stop body 164 is raised higher, in the direction of arrow 142, when the feedback temperature or the outdoor temperature increases (or the manual bias setting of dial 77 is increased). Either temperature rise calls for a lower ratio of hot supply to warm return water flow (more dilution). These temperatures are represented by the bulb fluid volume which expands from the bulbs 138 and 58, through the capillary tubes 139, 59 and 160, into the actuator head bellows 165, which is carried on bellows pedestal 171 that has radial spokes such as **171*a* and 171*b* that project through slots such as 164*a* and 164*b* in stop piston 164 and abuts bellows stop ring 172, which is embedded in the inside wall of housing 162. This causes the bellows to expand inside sleeve 166, driving the sleeve upward in housing 162 against captured actuator spring 167 and carrying the piston stop 140 upward in the housing in the direction of arrow 142. This, of course raises the stop position 141 and the valve stem follows it as urged by valve spring 136**, decreasing the ratio of hot supply water to warm return water flowing through the valve to the loop supply header (increasing dilution).

As in the first and second embodiments, the fluid volume that expands into the actuator head bellows 165 (the stop level) for a given feedback temperature depends on the outdoor temperature and the setting of dial 77 of ratio setter device 71. When the outdoor temperature drops, the outdoor bulb fluid volume decreases and so the given feedback temperature does not raise the stop as much and cause as much dilution. The relative effect of outdoor temperature on the stop position compared to the effect of the feedback temperature is adjustable: it depends on the setting of manual dial 77 of ratio setter device 71, as described more fully below.

Furthermore setting the manual dial 77 of device 71, even without a change in outdoor temperature or feedback temperature can be used to set the desired loop supply header water temperature. Thereafter, any change in feedback temperature will change the stop position. Thus, the manual setting of dial 77 is like a bias on the effect of feedback temperature.

The outdoor temperature ratio setter device 71 as used in the mixing valve control system 137 is essentially the same as described herein with respect to the first invention in which a diverting valve is used.

An automatic effect of the outdoor temperature that takes place even without a change in the manual setting of the bellows in device 71 arises as follows: on a very cold day it could be preferred that the maximum temperature of the loop supply header water be increased to provide more heat faster. This could be done by manually rotating dial 77 to increase the volume of the device bellows 75 so that less fluid flows to actuator bellows 165, lowering stop point 140, increasing the ratio of hot supply to warm return water flow through the mixing valve, raising the maximum temperature of the loop supply header water.

For added safety and ease of maintenance, the supply header 117 may be equipped with an air vent 146 and the return header may be equipped with a purge line 147 controlled by a manually operated valve 148. Supply water flow to each of heating loops may be controlled by a balancing valve with an internal position set screw. Such balancing valves for each loop are denoted 149. An alternate control for each loop could be an electrically operated power head like 151 each controlled by an electrical thermostat in the dwelling.

CONCLUSIONS

While the invention is described herein in connection with preferred embodiments, it will be understood that it is not intended to limit the invention to those embodiment. It is intended to cover all alternatives, modifications, equivalents and variations of those embodiments and their features as may be made by those skilled in the art within the spirit and scope of the invention as defined by the appended claims.

We claim:

1. In a hydronic heating system having a source of hot supply water and a reservoir of cooler return water, a supply water line from said source, a return water line to said reservoir and at least one heating loop through which water flows from said supply line to said return line, the improvement comprising:

(a) a three-way valve in said system for feeding return water directly from said return water line to the supply water line to reduce the temperature of water flow to said heating loop (loop water temperature), (b) a thermostatic control for controlling said valve to vary said loop water temperature, including (c) a loop water temperature bulb sensor containing thermostatic fluid responsive to said loop water temperature, (d) an outdoor temperature bulb sensor containing thermostatic fluid responsive to outdoor temperature, (e) a thermostatic valve actuator attached to said valve and (f) thermostatic fluid capillary tubes connecting said thermostatic fluid from said bulbs to said actuator, (g) whereby said loop water temperature is increased when said outdoor temperature falls.

2. A hydronic heating system as in claim 1 wherein:

(a) said thermostatic fluid is common to said loop water temperature bulb sensor said outdoor temperature bulb sensor and said valve actuator and (b) said thermostatic fluid expands as its temperature increases.

3. A hydronic heating system as in claim 1 wherein:

(a) said loop water temperature bulb iS attached to said loop supply water line, and (c) said thermostatic actuator controls said three-way valve water flow ratio.

4. A hydronic heating system as in claim 1 wherein:

(a) said three-way valve has a valve stem whose position determines said valve water flow ratio and a spring that urges said stem to a position of greater ratio and (b) said thermostatic actuator varies the position of said valve stem.

5. A hydronic heating system as in claim 3 wherein:

(a) said three-way valve has a valve stem whose position determines said valve water flow ratio and a spring that urges said stem to a position of greater ratio, (b) said thermostatic actuator controls the position of said valve stem, (c) said thermostatic actuator includes a bellows and (d) said thermostatic fluid fills said bellows.

6. A hydronic heating system as in claim 5 wherein:

(a) said bulbs, capillaries and said thermostatic actuator bellows contain a common thermostatic fluid that expands as its temperature increases and (b) said thermostatic fluid is an incompressible liquid.

7. A hydronic heating system as in claim 6 wherein:

(a) a thermostatic fluid adjusting device is provided for said thermostatic fluid for adjusting the effects of changes of said loop water temperature on said valve position.

8. A hydronic heating system as in claim 6 wherein:

(a) a thermostatic fluid adjusting device is provided for said thermostatic fluid for adjusting the effects of said outdoor bulb temperature on said valve position.

9. A hydronic heating system as in claim 8 wherein:

(a) said thermostatic fluid adjusting device is provided in the path of said outdoor bulb capillary tube that connects said thermostatic fluid from said outdoor bulb to said thermostatic valve actuator, for setting said loop water temperature.

10. A hydronic heating system as in claim 8 wherein:

(a) said thermostatic fluid adjusting device is provided in the path of said outdoor bulb capillary tube that connects said thermostatic fluid from said outdoor bulb to said thermostatic valve actuator, for setting the relationship between loop water temperature and outdoor temperature.

11. In a hydronic heating system having a source of hot supply water and a reservoir of cooler return water, a supply water line from said source, a return water line to said reservoir and at least one heating loop through which water flows from said supply line to said return line, the improvement comprising:

(a) a diverting valve in said return water line having a water flow input from said heating loop, a first water flow output to said reservoir and a second water flow output to said heating loop, (b) means for varying the ratio of water flow outputs from said diverting valve between said first and second water flow outputs, (b) whereby said water flow to said heating loop is diluted with said return water flowing from said diverting valve and (c) means responsive to the temperature of said diluted water flow and outdoor ambient temperature for controlling said ratio varying means including:

(d) a heating loop water temperature bulb sensor containing thermostatic fluid responsive to said heating loop water temperature, (e) an outdoor temperature bulb sensor containing thermostatic fluid responsive to outdoor temperature, (f) a thermostatic valve actuator attached to said diverting valve and (g) thermostatic fluid capillary tubes connecting said thermostatic fluid from said bulbs to said actuator.

12. A hydronic heating system as in claim 11 wherein:

(a) said thermostatic fluid is common to said loop water temperature bulb sensor three way actuator, said outdoor temperature bulb sensor and said valve actuator and (b) said thermostatic fluid expands as its temperature increases.

13. A hydronic heating system as in claim 11 wherein:

(a) said loop water temperature bulb is attached to said loop supply water line, and (c) said thermostatic actuator controls said three-way valve water flow ratio.

14. A hydronic heating system as in claim 11 wherein:

(a) said three-way valve has a valve stem whose position determines said valve water flow ratio and a spring that urges said stem to a position of greater ratio and (b) said thermostatic actuator varies the position of said valve stem.

15. A hydronic heating system as in claim 13 wherein:

(a) said three-way valve has a valve stem whose position determines said valve water flow ratio and a spring that urges said stem to a position of greater ratio, (b) said thermostatic actuator controls the position of said valve stem, (c) said thermostatic actuator includes a bellows and (d) said thermostatic fluid fills said bellows.

16. A hydronic heating system as in claim 15 wherein:

(a) said bulbs, capillaries and said thermostatic actuator bellows contain a common thermostatic fluid that expands as its temperature increases and (b) said thermostatic fluid is an incompressible liquid.

17. A hydronic heating system as in claim 16 wherein:

(a) a thermostatic fluid adjusting device is provided for said thermostatic fluid for adjusting the effects of changes of said loop water temperature on said valve position.

18. A hydronic heating system as in claim 16 wherein:

(a) a thermostatic fluid adjusting device is provided for said thermostatic fluid for adjusting the effects of said outdoor bulb temperature on said valve position.

19. A hydronic heating system as in claim 18 wherein:

(a) said thermostatic fluid adjusting device is provided in the path of said outdoor bulb capillary tube that connects said thermostatic fluid from said outdoor bulb to said thermostatic valve actuator, for setting said loop water temperature.

20. A hydronic heating system as in claim 18 wherein:

(a) said thermostatic fluid adjusting device is provided in the path of said outdoor bulb capillary tube that connects said thermostatic fluid from said outdoor bulb to said thermostatic valve actuator, for setting the relationship between loop water temperature and outdoor temperature.

21. In a hydronic heating system having a source of hot supply water and a reservoir of cooler return water, a supply water line from said source, a return water line to said reservoir and at least one heating loop through which water flows from said supply line to said return line, the improvement comprising:

(a) a three-way valve in said system for feeding return water directly from said return water line to the supply water line to reduce the temperature of water flow to said heating loop (loop water temperature), (b) a thermostatic control for controlling said valve to vary said loop water temperature, including (c) a loop water temperature bulb sensor containing thermostatic fluid responsive to said loop water temperature, (d) an outdoor temperature bulb sensor containing thermostatic fluid responsive to outdoor temperature, (e) a thermostatic valve actuator attached to said valve, (f) thermostatic fluid capillary tubes connecting said thermostatic fluid from said bulbs to said actuator, (g) a thermostatic fluid adjusting device for said thermostatic fluid for adjusting the effects of said outdoor bulb temperature on said valve position and (h) said bulbs, capillaries, actuator and adjusting device contain a common thermostatic fluid that expands as its temperature increases, (i) whereby said loop water temperature is increased when said outdoor temperature falls.

22. A hydronic heating system as in claim 21 wherein:

(a) said thermostatic fluid is an incompressible liquid.

23. A hydronic heating system as in claim 21 wherein:

(a) said thermostatic adjusting device is a variable adjusting bellows and (b) means are provided varying the volume of said variable adjusting bellows.

24. A hydronic heating system as in claim 23 wherein:

(a) a scale is provided for said means for varying the volume of said variable adjusting bellows and (b) said scale reading indicates the effect of said outdoor bulb temperature on said diluted loop supply water temperature.

25. A hydronic heating system as in claim 23 wherein:

(a) said means for varying the volume of said variable adjusting bellows is a dial connected to said adjusting bellows, (b) whereby turning said dial in one direction compresses said bellows and turning it in the opposite direction expands said bellows.

26. A hydronic heating system as in claim 21 wherein:

(a) said adjusting device is in the path of said outdoor bulb capillary tube that connects said thermostatic fluid from said outdoor bulb to said valve actuator.

27. A hydronic heating system as in claim 21 wherein:

(a) said three-way valve has a valve stem whose position determines said valve water flow ratio and a spring that urges said stem to a position of greater ratio and (b) said thermostatic actuator varies the position of said valve stem.

28. A hydronic heating system as in claim 27 wherein:

(a) said three-way valve has a valve stem whose position determines said valve water flow ratio and a spring that urges said stem to a position of greater ratio, (b) said thermostatic actuator controls the position of said valve stem, (c) said thermostatic actuator includes a bellows and (d) said thermostatic fluid fills said actuator bellows.

* * * * *